US009909291B2

(12) United States Patent
Hart et al.

(10) Patent No.: US 9,909,291 B2
(45) Date of Patent: Mar. 6, 2018

(54) SANITARY FITTED ELEMENT FOR A WATER OUTLET

(75) Inventors: Keith Hart, Worcestershire (GB); Gerhard Blum, Gutach (DE); Marc Tempel, Freiburg (DE); Christoph Weis, Mullheim (DE)

(73) Assignee: Neoperl GmbH, Müllheim (DE)

( * ) Notice: Subject to any disclaimer, the term of this patent is extended or adjusted under 35 U.S.C. 154(b) by 490 days.

(21) Appl. No.: 13/700,279

(22) PCT Filed: Mar. 14, 2011

(86) PCT No.: PCT/EP2011/001250

§ 371 (c)(1),
(2), (4) Date: Nov. 27, 2012

(87) PCT Pub. No.: WO2011/147495

PCT Pub. Date: Dec. 1, 2011

(65) Prior Publication Data

US 2013/0075496 A1 Mar. 28, 2013

(30) Foreign Application Priority Data

May 27, 2010 (DE) ..... 20 2010 007 202

(51) Int. Cl.

| | |
|---|---|
| ***E03C 1/08*** | (2006.01) |
| ***E03C 1/084*** | (2006.01) |
| ***B05B 1/30*** | (2006.01) |
| ***B05B 7/04*** | (2006.01) |
| *E03C 1/02* | (2006.01) |

(52) U.S. Cl.

CPC ..... *E03C 1/084* (2013.01); *B05B 1/3033* (2013.01); *B05B 1/3073* (2013.01); *B05B 7/0425* (2013.01); *E03C 1/08* (2013.01); *E03C 2001/026* (2013.01)

(58) Field of Classification Search

CPC ..... E03C 1/084; E03C 1/08; E03C 2001/026; B05B 1/3073; B05B 1/3033; B05B 7/0425

USPC ..... 239/428.5, 581.1, 581.2, 437, 438, 239/537–541

See application file for complete search history.

(56) References Cited

U.S. PATENT DOCUMENTS

| | | | | |
|---|---|---|---|---|
| 3,876,151 | A * | 4/1975 | Katva | B05B 1/1609 239/417.3 |
| 3,979,064 | A * | 9/1976 | Nordentoft | B05B 1/185 239/107 |
| 5,095,558 | A * | 3/1992 | Howard | 4/541.6 |

FOREIGN PATENT DOCUMENTS

| | | |
|---|---|---|
| DE | 3510107 | 10/1985 |
| DE | 102006057795 | 2/2008 |
| DE | 102008050247 | 3/2010 |
| FR | 2907874 | 5/2008 |

(Continued)

*Primary Examiner* — Jason Boeckmann

(74) *Attorney, Agent, or Firm* — Volpe and Koenig, P.C.

(57) ABSTRACT

A sanitary fitted element (1) which can be inserted into the water outlet of a sanitary outlet fitting and is held releasably there. A characteristic feature of the fitted element (1) according to the invention is that said fitted element has an adjusting device for changing the clear sectional area of flow of the fitted element (1) and/or the discharge rate, which adjusting device is actuable via at least one control element (8) which is arranged actuably on the inflow side of the fitted element (1) and/or on the outflow side thereof. The fitted element (1) according to the invention can be used in a versatile manner in order to reduce the outlay on production and stock.

15 Claims, 19 Drawing Sheets

(56) References Cited

FOREIGN PATENT DOCUMENTS

| | | |
|---|---|---|
| WO | 9420219 | 9/1994 |
| WO | 2010031300 | 3/2010 |

* cited by examiner

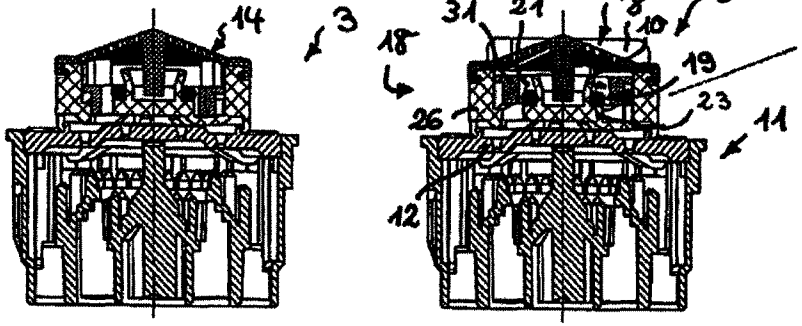
Fig. 13
Fig. 15
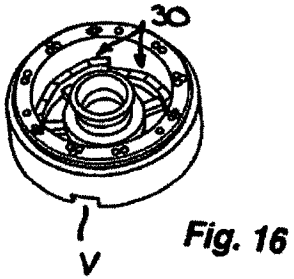
Fig. 16
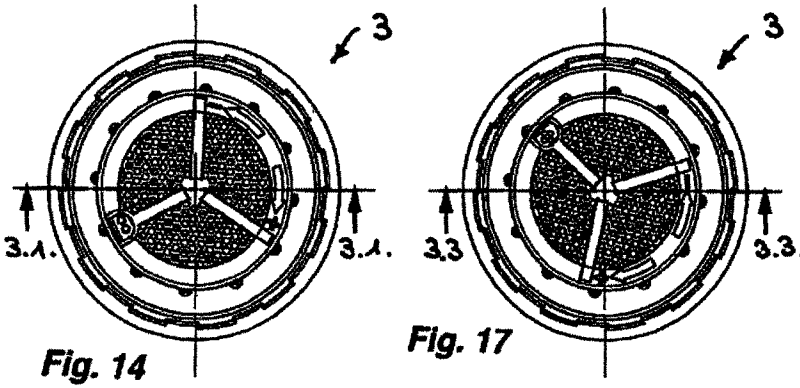
Fig. 14
Fig. 17

SANITARY FITTED ELEMENT FOR A WATER OUTLET

BACKGROUND

The invention relates to a sanitary installation element which can be inserted into the water outlet of a sanitary outlet fitting and which has an adjustment device for varying the clear throughflow cross section of the installation element and/or the volume flow, which adjustment device can be actuated by means of at least one operating element which is arranged, such that it can be actuated, on the inflow side of the installation element and/or on the outflow side of said installation element, wherein the adjustment device has a regulating element and, interacting therewith, an adjustment element, the relative position of which can be varied by means of the at least one operating element in order to vary the throughflow cross section or the throughflow rate.

Various sanitary installation elements are already known which can be mounted on the water outlet of a sanitary outlet fitting in order to regulate or form the water jet emerging therefrom. Various jet regulators have already been created, the intention of which is to form the water jet emerging from the water outlet of a sanitary outlet fitting into a homogeneous, non-sputtering and if appropriate also sparkling, soft overall jet.

An installation element of the type mentioned in the introduction which can be mounted on the water outlet of a sanitary outlet fitting is already known from FR 2 907 874 A, which installation element provides the user with a selection of different throughflow cross sections. For this purpose, the already known installation element has an adjustment device which can be actuated by means of a sleeve-shaped operating element which forms the outlet-side face edge of the installation element. The operating element which is guided so as to be displaceable in the longitudinal direction of the installation element is drive-connected to a cylindrical adjustment element, which is rotatably mounted in the installation element transversely with respect to the longitudinal axis thereof, in such a way that an axial exertion of pressure on the operating element can be converted into a rotational movement of the adjustment element. In the adjustment element there are a plurality of throughflow ducts available for selection, which throughflow ducts interact with the adjoining wall regions, which serve as a regulating element, of the installation element in such a way that a throughflow duct of larger throughflow cross section or a throughflow duct of relatively small throughflow cross section can be selected, or the throughflow through the installation element can be completely blocked.

Also already known, from DE 10 2006 057 795 B, is a sanitary installation element which can likewise be inserted into the water outlet of a sanitary outlet fitting and is designed as a jet regulator. The already known jet regulator which serves as an installation element is intended to form the water emerging from the outlet fitting into a homogeneous and non-sputtering water jet. The already known installation element has a central cleaning duct, the duct inlet of which is provided on the base of a concave upstream screen which is provided upstream at the inflow side and which tapers in the throughflow direction. In the region of the duct opening there is provided an adjustment device which is formed as a shut-off valve, the valve body of which can be moved from an open position into a closed position counter to a restoring force either under the pressure of the inflowing water or else manually by means of an operating element connected to the valve body. Since, after every withdrawal of water, the shut-off valve re-opens the duct opening leading to the cleaning duct, it is possible, during a subsequent withdrawal of water, for the dirt particles which are entrained in the water and which have been retained on the screen surface of the upstream screen to firstly be flushed away through the cleaning duct before the shut-off valve closes again during the withdrawal of water. Every opening and closing movement of the shut-off valve simultaneously entails an increase or decrease in size, and thus a variation, of the throughflow cross section of the installation element.

Since different sanitary water system specifications exist in different countries, a corresponding multiplicity of jet regulators is required in order to allow for the country-specific specifications. The multiplicity of jet regulators requires a not inconsiderable outlay in terms of production and stockkeeping. Since the outlet fittings sold by different manufacturers exhibit different and sometimes also high hydraulic resistances, different throughflow rate regulators are required in order to regulate the maximum water quantity emerging per unit time, as a result of which the outlay in terms of production and stockkeeping is additionally increased.

SUMMARY

It is therefore the object in particular to create a sanitary installation element of the type mentioned in the introduction, which sanitary installation element can be used in as versatile a manner as possible in order to reduce the outlay in terms of production and stockkeeping and in order to provide adaptation to the individual demands of the respective user and/or to the specific sanitary environmental conditions.

In the case of the sanitary installation element of the type mentioned in the introduction, said object is a achieved according to the invention in particular in that at least one operating element is mounted so as to be rotatable but immovable in the longitudinal direction, in that the adjustment element is guided so as to be displaceable in the longitudinal direction and rotationally fixed, and in that a rotational movement at said operating element can be converted into a longitudinal movement of the adjustment element.

The installation element according to the invention, which can be inserted into the water outlet of a sanitary outlet fitting and is releasably held there, has an adjustment device which is designed for varying the clear throughflow cross section of the installation element and/or the throughflow rate. The adjustment device of the installation element according to the invention can be actuated by means of at least one operating element which is arranged, such that it can be actuated, on the inflow side of the installation element and/or on the outflow side thereof. The adjustment device has a regulating element and, interacting therewith, an adjustment element, the relative position of which can be varied by means of the at least one operating element in order to vary the throughflow cross section or the throughflow rate. While at least one operating element is mounted so as to be rotatable but immovable in the longitudinal direction, the adjustment element which interacts therewith is guided so as to be displaceable in the longitudinal direction and rotationally fixed, in such a way that a rotational movement at the operating element can be converted into a longitudinal movement of the adjustment element. By actuation of the adjustment device at the operating element arranged on the inflow or outflow side of the installation element, the clear throughflow cross section and/or the maximum amount of water emerging per unit time can be varied such that the installation element according to the invention is suited to the different local preconditions in the distribution network. Since one and the same installation element can be adapted to the specifications of the water networks existing in different countries, the production and stockkeeping of different jet regulator designs is no longer imperatively necessary.

In order to attain a controlled and/or repeatable adjustment movement, it is expedient if the adjustment element is guided so as to be movable in the longitudinal direction of the adjustment device.

The rotational movement at the operating element can be converted into a longitudinal movement of the adjustment element in a particularly simple manner if a threaded peg arranged preferably coaxially with respect to the adjustment device protrudes from at least one operating element, which threaded peg engages into a threaded opening in the adjustment element.

The already-known installation elements generally have, at the inflow side, a filter or upstream screen, the intention of which is to retain dirt particles inadvertently entrained in the water and to protect the installation element against blockages caused by dirt.

One preferred refinement, which is worthy of protection in its own right, provides that the adjustment device is in the form of a throughflow rate regulator which has an annular throttle body composed of elastic material and which delimits a control gap between itself and a regulating profiling provided on an adjacent inner and/or outer circumferential wall, which control gap can be varied in terms of its clear throughflow cross section by means of the throttle body which deforms under the pressure of the fluid flowing through. Such an adjustment device designed as an adjustable throughflow rate regulator allows the sanitary installation element to be set to a throughflow rate which corresponds to the existing specifications of the water network at the usage site.

In order to be able to realize different preselectable throughflow rates by means of such an adjustment device in the form of a throughflow rate regulator, it is advantageous if the inner and/or the outer circumferential wall, at least in their partial region which has the regulating profiling, and/or the regulating profiling, widen in terms of their clear cross section in the longitudinal direction.

It is expedient if a support intended for providing support for the throttle body, or the inner and/or outer circumferential wall which has the regulating profiling, is designed as an adjustment element which interacts with the inner and/or outer circumferential wall which is designed as a regulating element or with the support. Whereas one exemplary embodiment provides that the support intended for providing support for the throttle body is designed as an adjustment element and the inner an/or outer circumferential wall is designed as a regulating element, another exemplary embodiment, by contrast, consists in that the inner and/or outer circumferential wall serves as an adjustment element and the support intended for providing support for the throttle body serves as a regulating element.

The versatility of the installation element according to the invention is enhanced if the adjustment device can be releasably fastened on the inflow side of a jet regulator or similar sanitary installation part. Such an installation element, in which the adjustment device is releasably fastened on the jet regulator or the like, may selectively be operated either with or without the adjustment device.

Further features of the invention will emerge from the description and from the claims. The invention will be described in even greater detail below on the basis of various exemplary embodiments.

BRIEF DESCRIPTION OF THE DRAWINGS

In the figures:

FIG. 13 shows a sanitary installation element illustrated in a longitudinally sectioned rotational position, said sanitary installation element having an adjustment device likewise in the form of a throughflow rate regulator, wherein on the housing inner circumference of the adjustment device there are provided ramps, on which a profile ring which has regulating profilings rests so as to be displaceable in the longitudinal direction, FIG. 14 shows the installation element shown in the rotational position as per FIG. 13 in a plan view of its inflow side, FIG. 15 shows the longitudinally sectioned installation element from FIGS. 13 and 14 in a different position of adjustment, FIG. 16 shows a perspective plan view of the housing of the installation element illustrated in FIGS. 13 to 15, wherein the ramps of the adjustment device are clearly visible on the housing inner circumference, FIG. 17 shows the installation element shown in the rotational position as per FIG. 15 in a plan view of its inflow side.

DETAILED DESCRIPTION OF THE PREFERRED EMBODIMENTS

Figure 1:
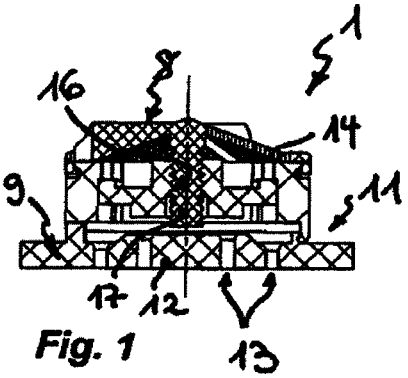
FIG. 1 shows a sanitary installation element illustrated in a longitudinally sectioned rotational position, which sanitary installation element comprises, at the outflow side, a jet regulator with a jet splitter formed as a perforated plate, wherein the throughflow holes provided in the perforated plate which serves as a jet splitter are arranged in concentric hole circles, of which at least one hole circle—or, not illustrated here, at least a part of at least one hole circle—can be opened and closed by means of an adjustment element which is displaceable in the longitudinal direction of the adjustment device.
Figure 3:
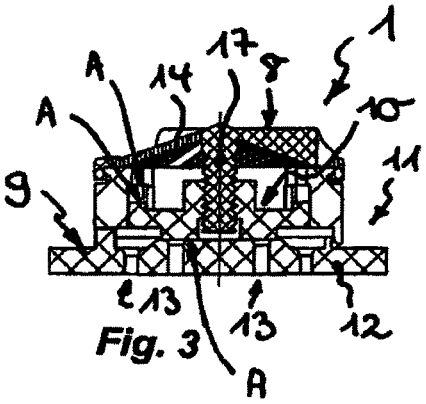
FIG. 3 shows the longitudinally sectioned installation element from FIGS. 1 and 2 in a different position of adjustment.
Figure 2:
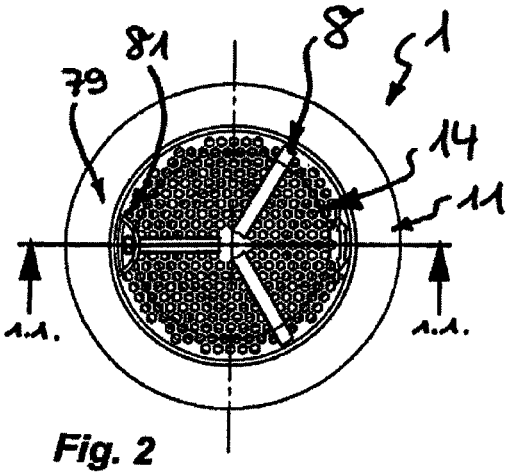
FIG. 2 shows the installation element shown in the rotational position as per FIG. 1 in a plan view of its inflow side.
Figure 4:
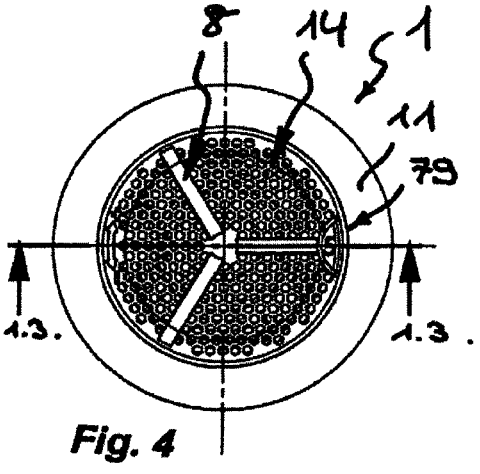
FIG. 4 shows the installation element shown in the rotational position as per FIG. 3 in a plan view of its inflow side.
Figure 6:
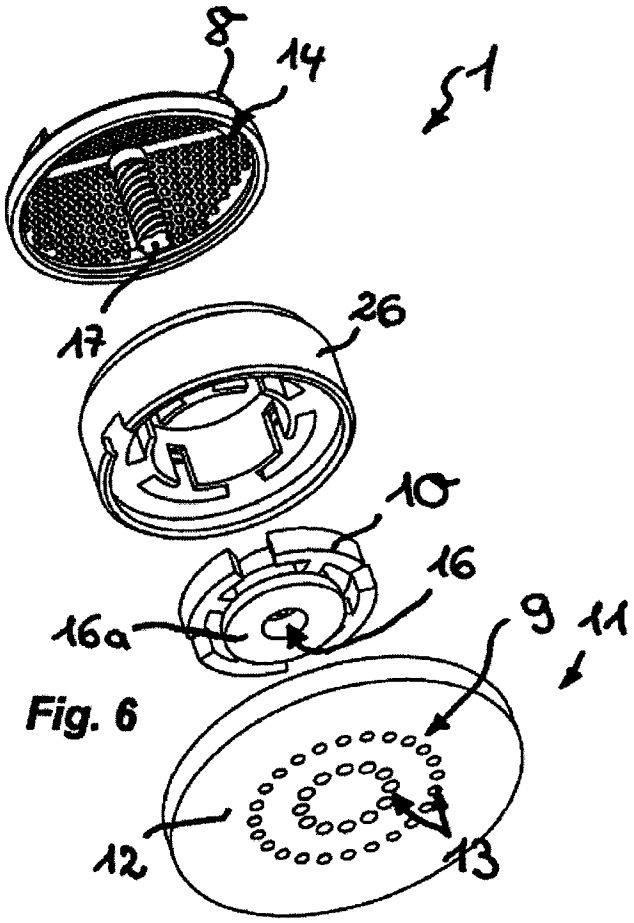
FIG. 6 shows the installation element from FIGS. 1 to 5 in an exploded illustration, oriented counter to the throughflow direction, of its individual parts.
Figure 5:
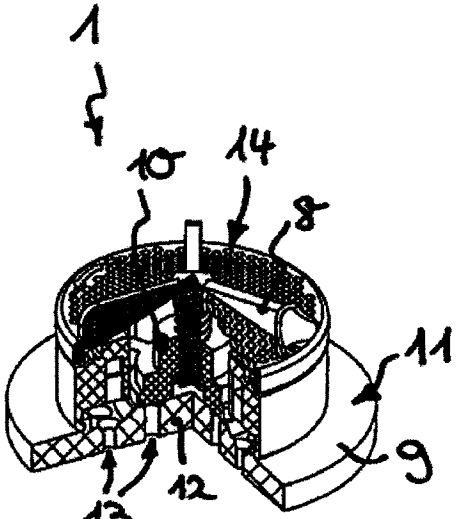
FIG. 5 shows the installation element from FIGS. 1 to 4 in a perspective partial longitudinal section.
Figure 11:
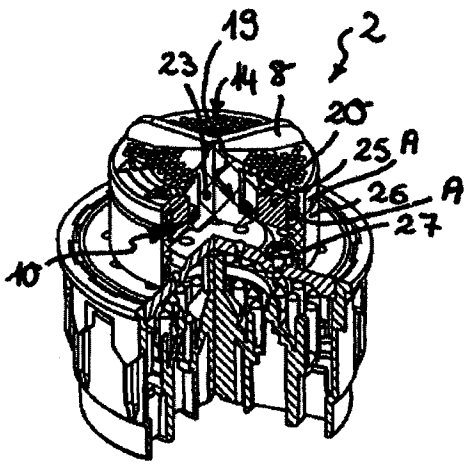
FIG. 11 shows the installation element from FIGS. 7 to 10 in a perspective partial longitudinal section.
Figure 9:
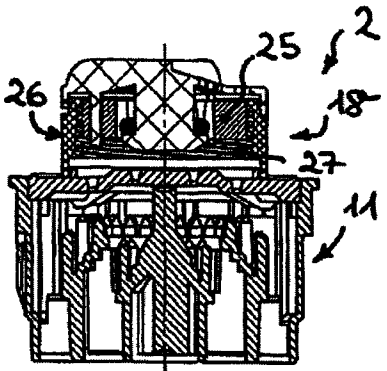
FIG. 9 shows the longitudinally sectioned installation element from FIGS. 7 and 8 in a different position of adjustment.
Figure 10:
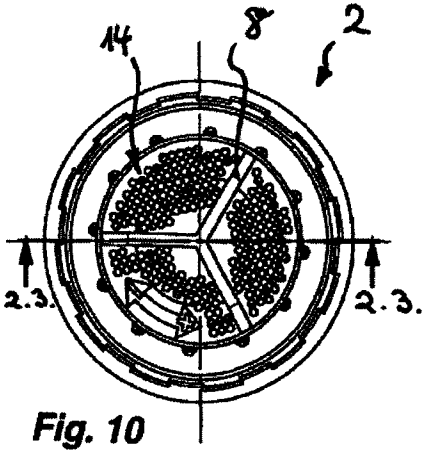
FIG. 10 shows the installation element shown in the rotational position as per FIG. 9 in a plan view of its inflow side.
Figure 7:
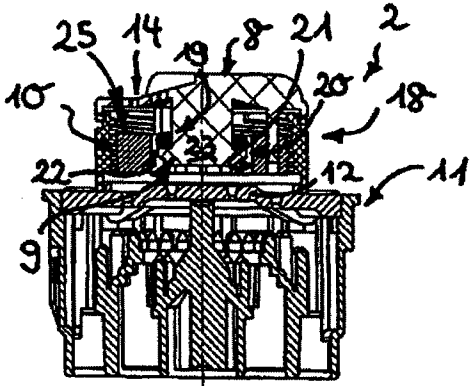
FIG. 7 shows a sanitary installation element illustrated in a longitudinally sectioned rotational position, which sanitary installation element comprises, at the outflow side, a jet regulator, upstream of which on the inflow side is positioned an adjustment device in the form of a throughflow rate regulator, wherein the throughflow rate regulator which serves as an adjustment device has a profile ring which is guided so as to be displaceable in the longitudinal direction and which interacts with an annular throttle body composed of elastic material.
Figure 8:
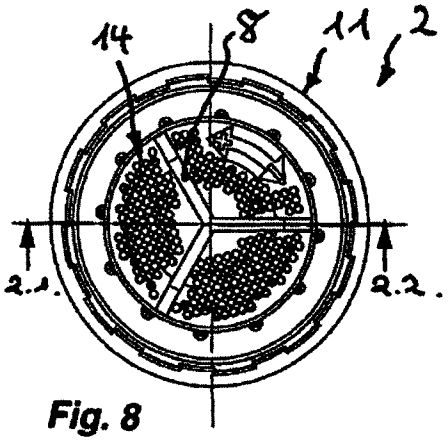
FIG. 8 shows the installation element shown in the rotational position as per FIG. 7 in a plan view of its inflow side.
Figure 12:
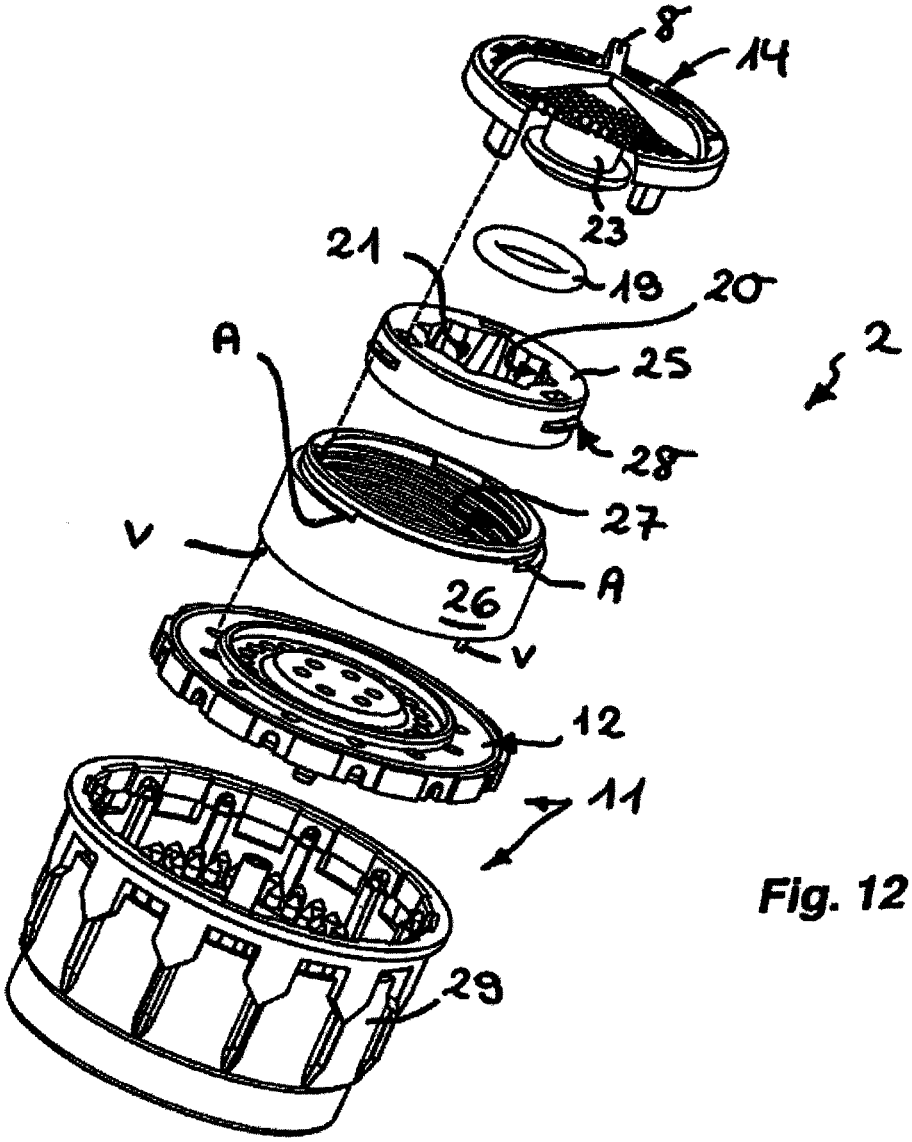
FIG. 12 shows the installation element from FIGS. 7 to 11 in an exploded illustration, shown in a lateral perspective view, of its individual parts.
Figure 19:
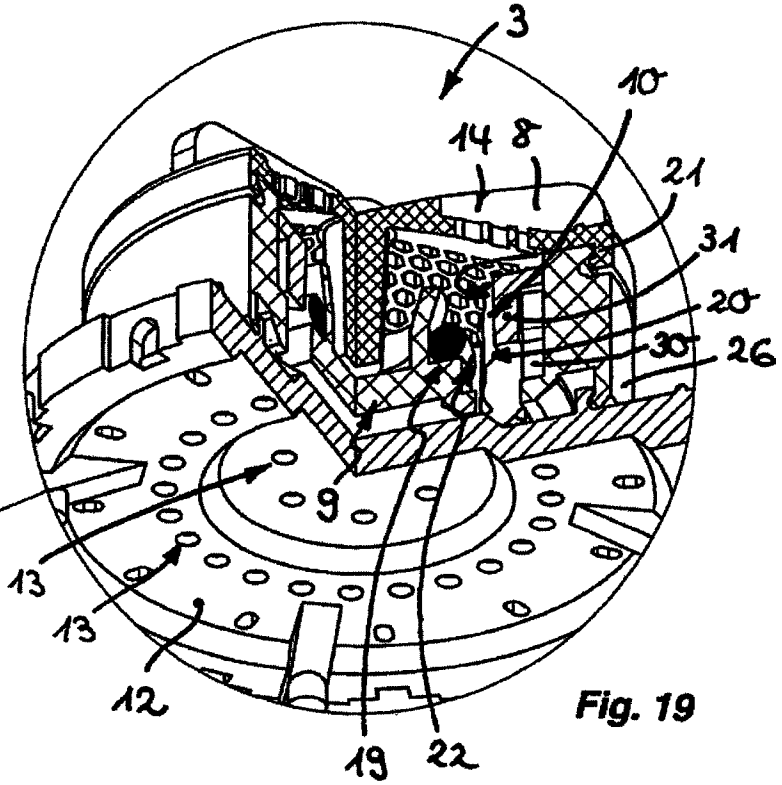
FIG. 19 shows the installation element from FIGS. 13 to 18 in an enlarged-scale longitudinal section detail from FIG. 18.
Figure 18:
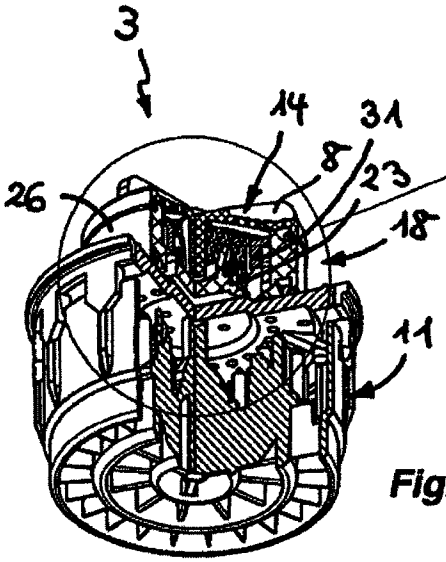
FIG. 18 shows the installation element from FIGS. 13 to 17 in a perspective partial longitudinal section oriented counter to the throughflow direction.
Figure 20:
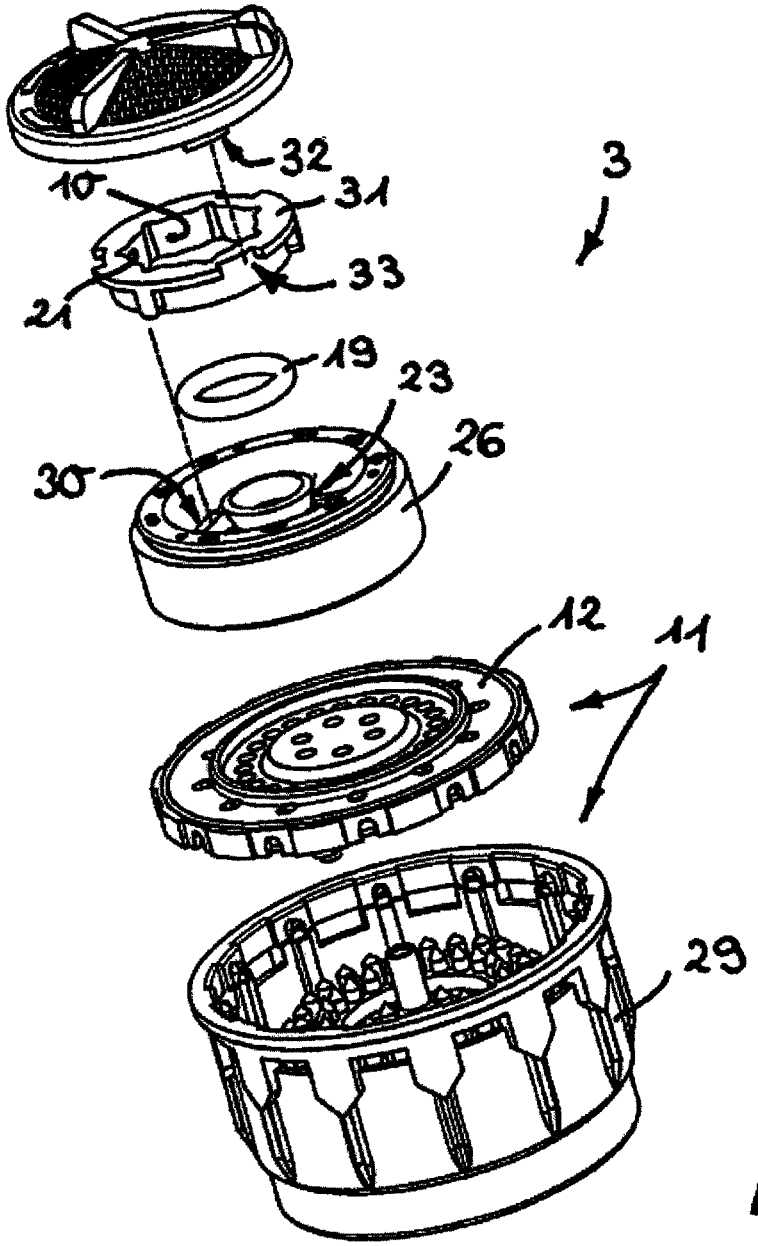
FIG. 20 shows the installation element from FIGS. 13 to 19 in an exploded perspective view of its individual parts.
Figure 21:
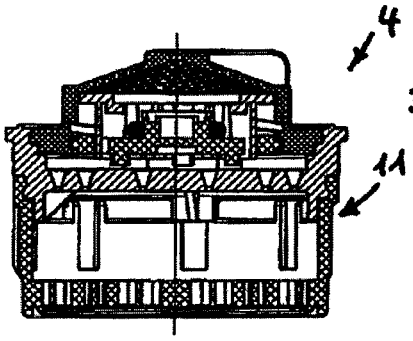
FIG. 21 shows a sanitary installation element illustrated in a longitudinally sectioned rotational position, said sanitary installation element having, at the inflow side, an adjustment device, in which the housing of the adjustment device is held in a rotatable manner on the inflow side of a jet regulator in such a way that a rotational movement of the housing can be converted into a longitudinal movement of the support intended for providing support for the throttle body.
Figure 23:
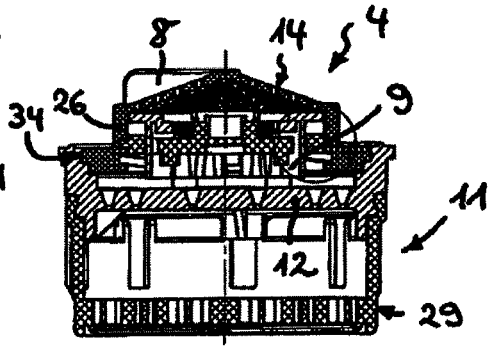
FIG. 23 shows the longitudinally sectioned installation element from FIGS. 21 and 22 in a different position of adjustment.
Figure 22:
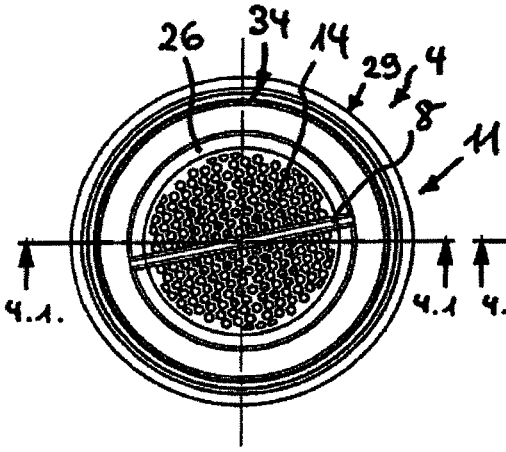
FIG. 22 shows the installation element shown in the rotational position as per FIG. 21 in a plan view of its inflow side.
Figure 24:
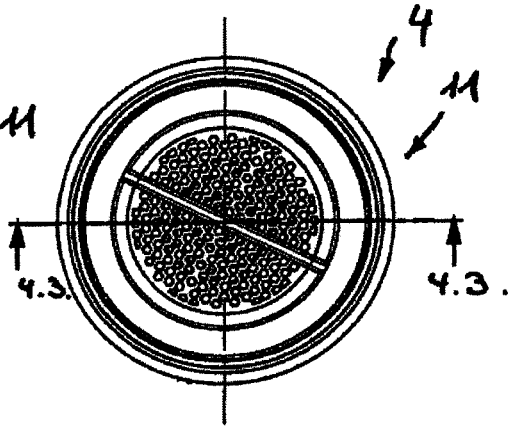
FIG. 24 shows the installation element shown in the rotational position as per FIG. 23 in a plan view of its inflow side.
Figure 26:
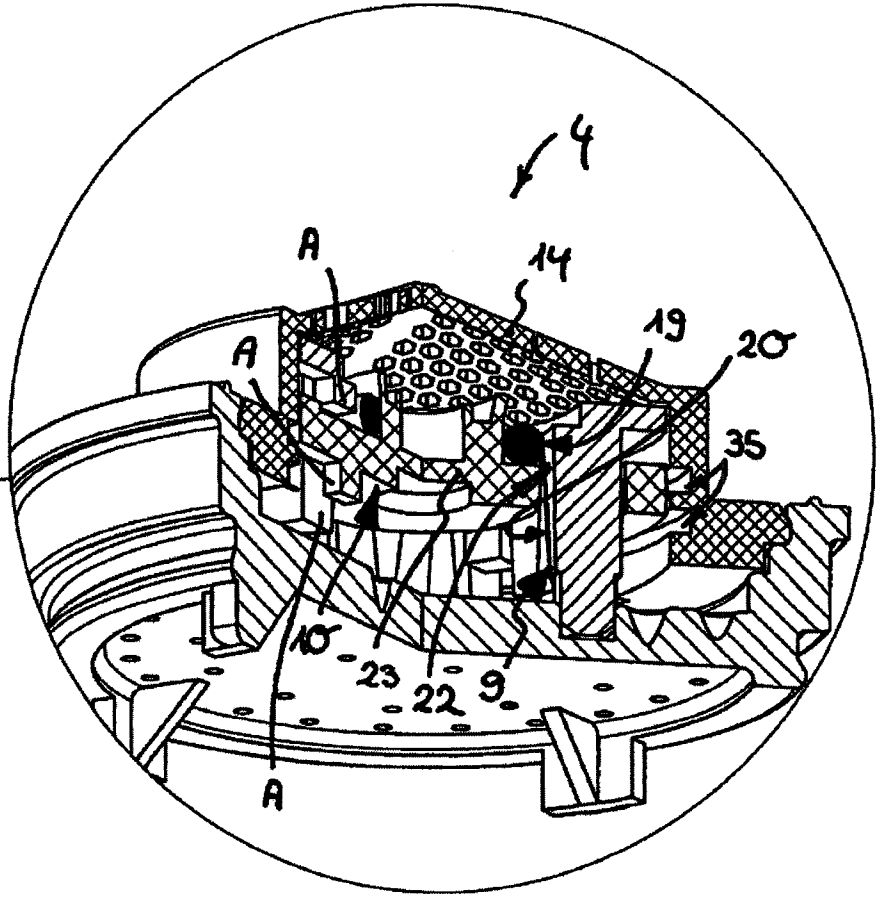
FIG. 26 shows the installation element from FIGS. 21 to 25 in an enlarged-scale longitudinal section detail from FIG. 25.
Figure 25:
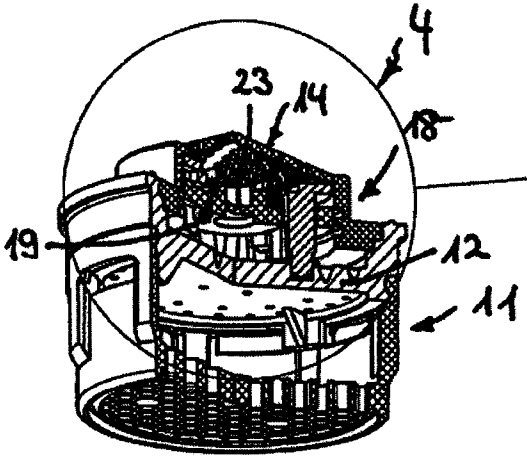
FIG. 25 shows the installation element from FIGS. 21 to 24 in a perspective partial longitudinal section.
Figure 27:
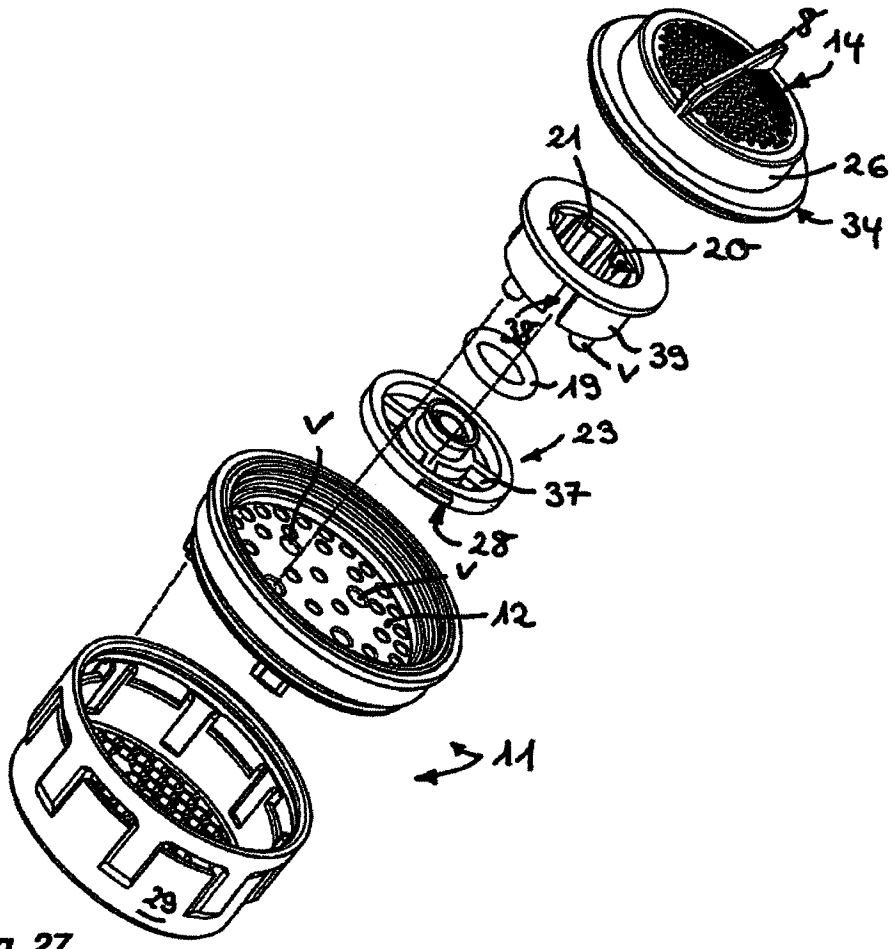
FIG. 27 shows the installation element from FIGS. 21 to 26 in an exploded perspective illustration of its individual parts.
Figure 29:
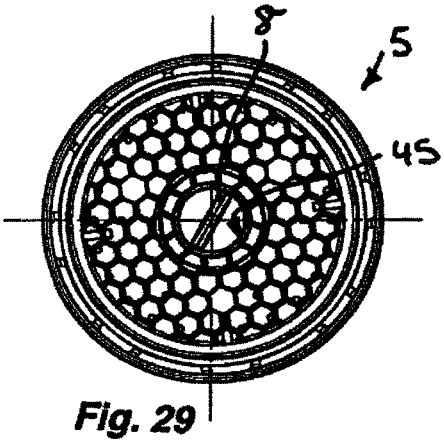
FIG. 29 shows the installation element shown in the rotational position as per FIG. 28 in a plan view of its inflow side.
Figure 31:
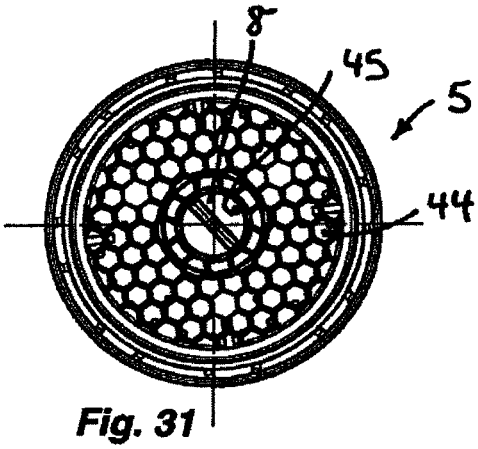
FIG. 31 shows the installation element shown in the rotational position as per FIG. 30 in a plan view of its inflow side.
Figure 28:
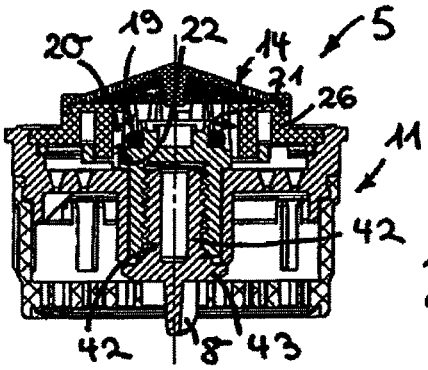
FIG. 28 shows a sanitary installation element illustrated in a longitudinally sectioned rotational position, said sanitary installation element having an adjustment device which can be actuated by means of an operating element provided in this case at the outflow side.
Figure 30:
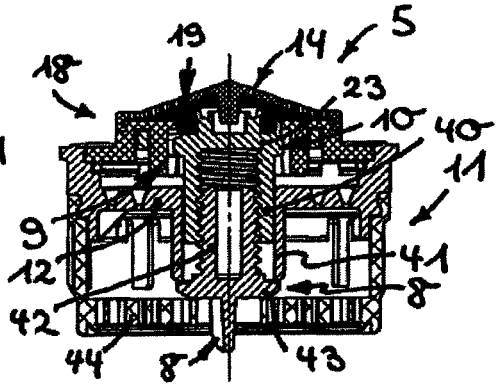
FIG. 30 shows the longitudinally sectioned installation element from FIGS. 28 and 29 in a different position of adjustment.
Figure 33:
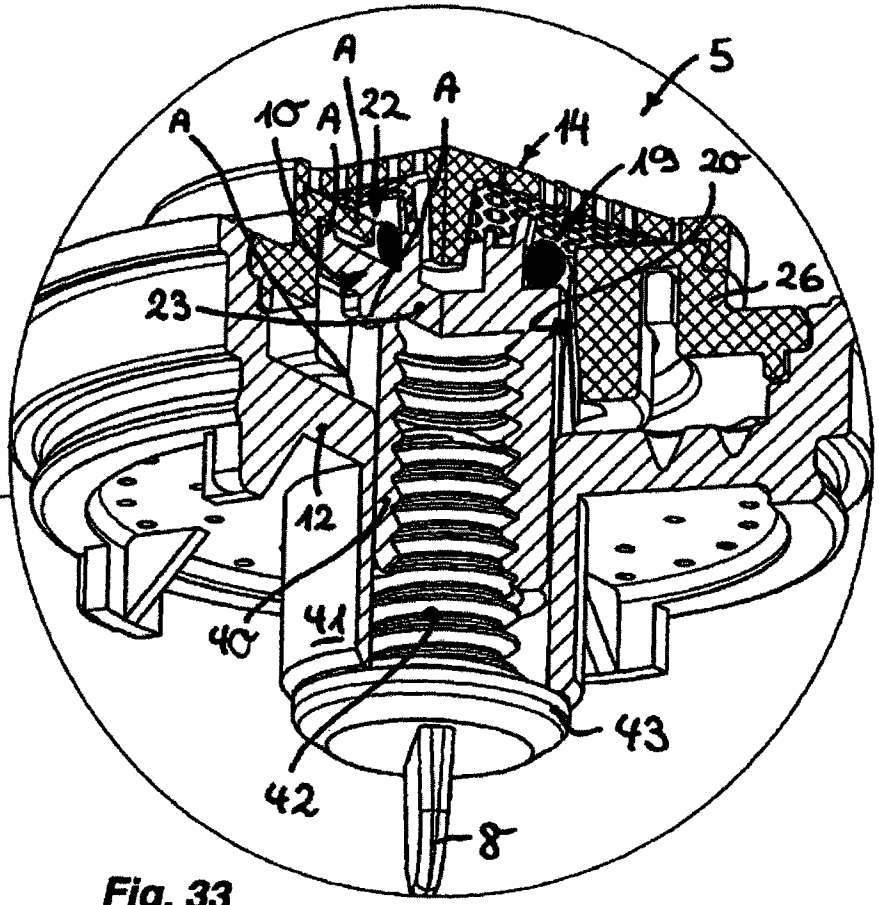
FIG. 33 shows the installation element from FIGS. 28 to 32 in an enlarged-scale longitudinal section detail from FIG. 32.
Figure 32:
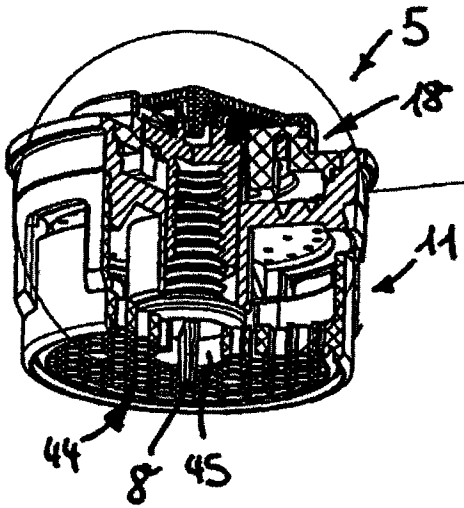
FIG. 32 shows the installation element from FIGS. 28 to 31 in a perspective partial longitudinal section.
Figure 34:
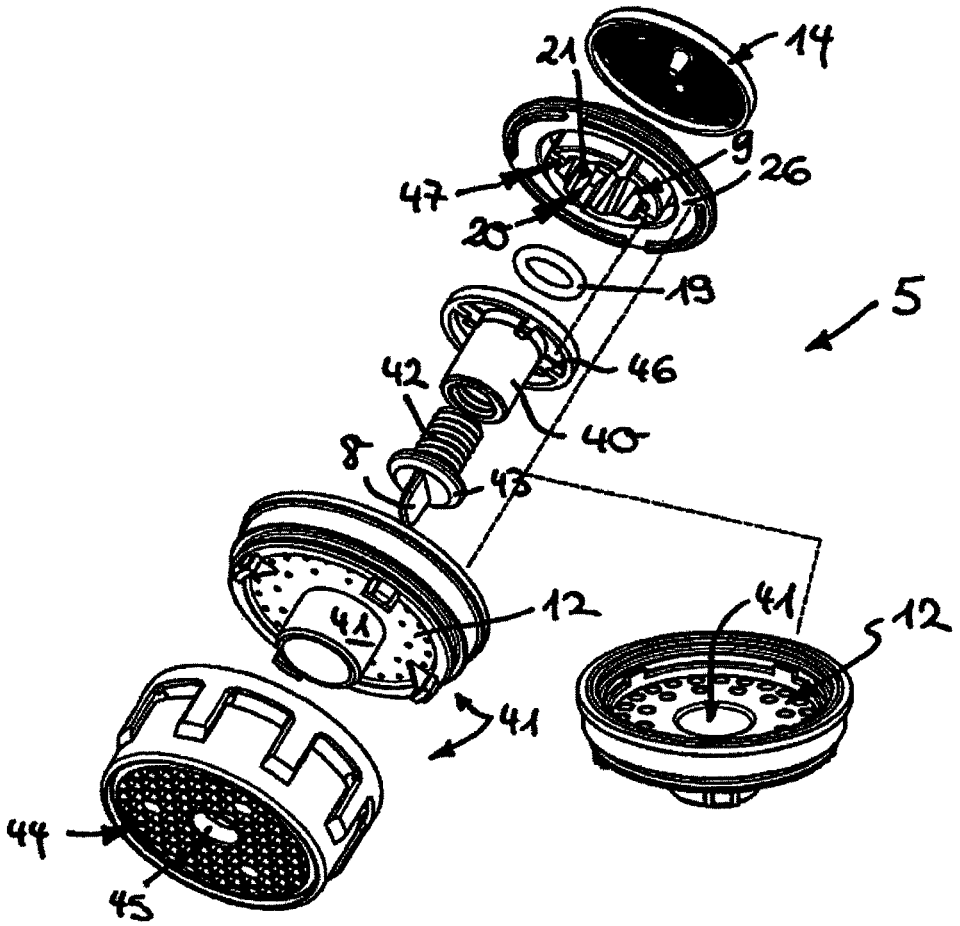
FIG. 34 shows the installation element from FIGS. 28 to 33 in an exploded perspective illustration, oriented counter to the throughflow direction, of its individual parts.
Figure 35:
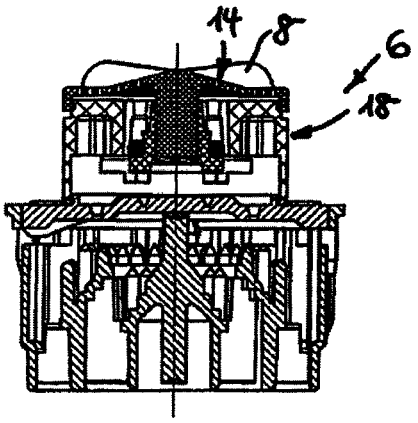
FIG. 35 shows a sanitary installation element illustrated in a longitudinally sectioned rotational position, said sanitary installation element having, at the inflow side, an adjustment device which is designed as a throughflow rate regulator, wherein the support provided for the annular throttle body is guided, so as to be displaceable in the longitudinal direction, in the housing interior of the adjustment device.
Figure 37:
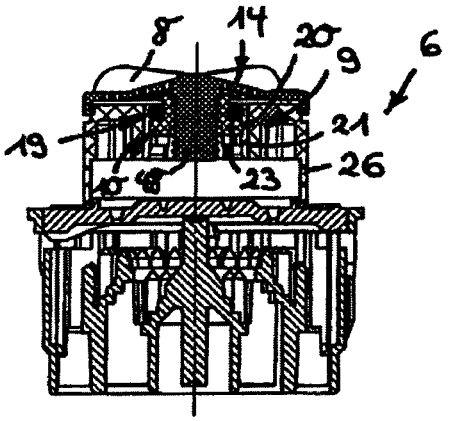
FIG. 37 shows the longitudinally sectioned installation element from FIGS. 35 and 36 in a different position of adjustment.
Figure 36:
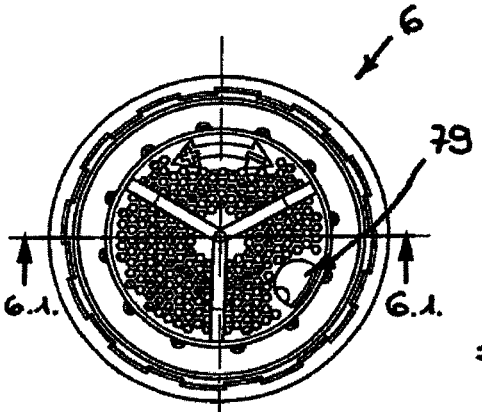
FIG. 36 shows the installation element shown in the rotational position as per FIG. 35 in a plan view of its inflow side.
Figure 38:
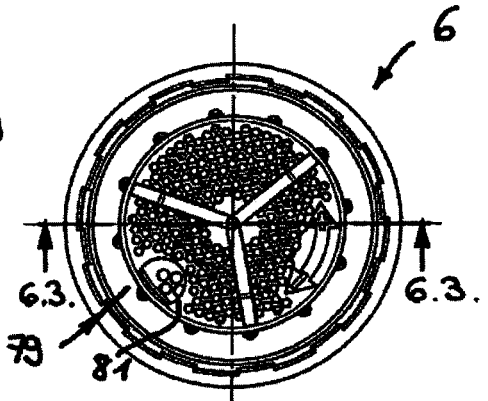
FIG. 38 shows the installation element shown in the rotational position as per FIG. 37 in a plan view of its inflow side.
Figure 40:
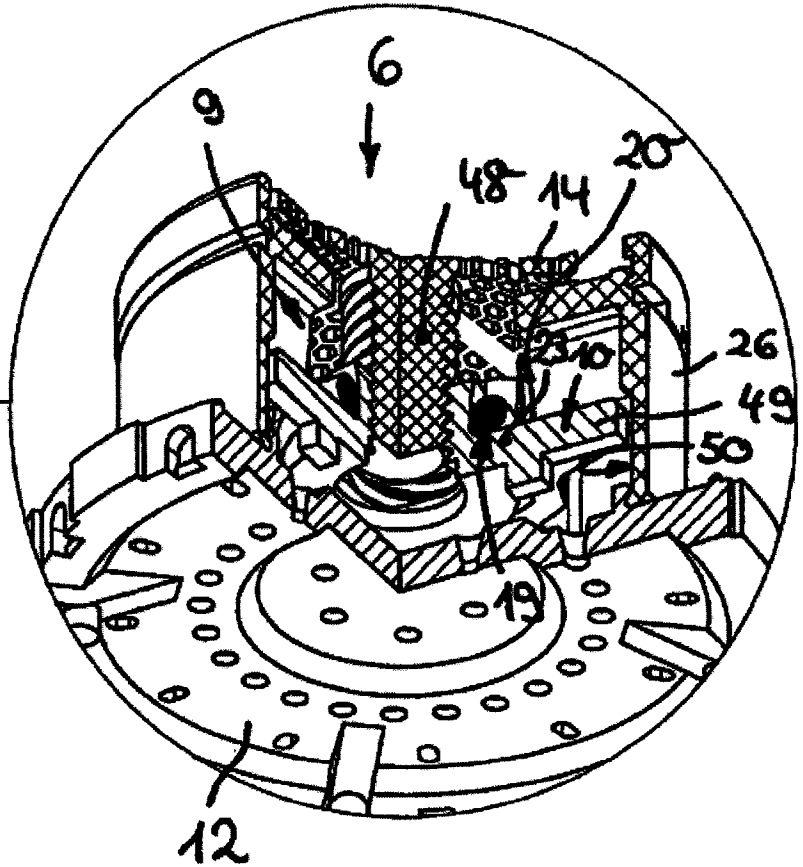
FIG. 40 shows the installation element from FIGS. 35 to 39 in an enlarged-scale longitudinal section detail from FIG. 39.
Figure 39:
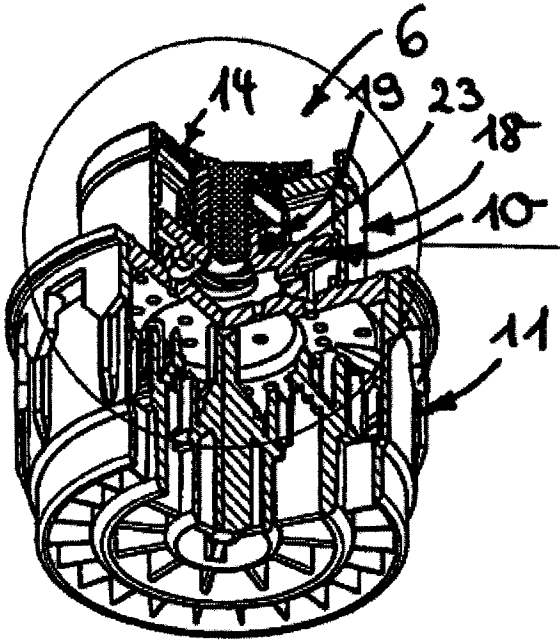
FIG. 39 shows the installation element from FIGS. 35 to 38 in a perspective partial longitudinal section.
Figure 41:
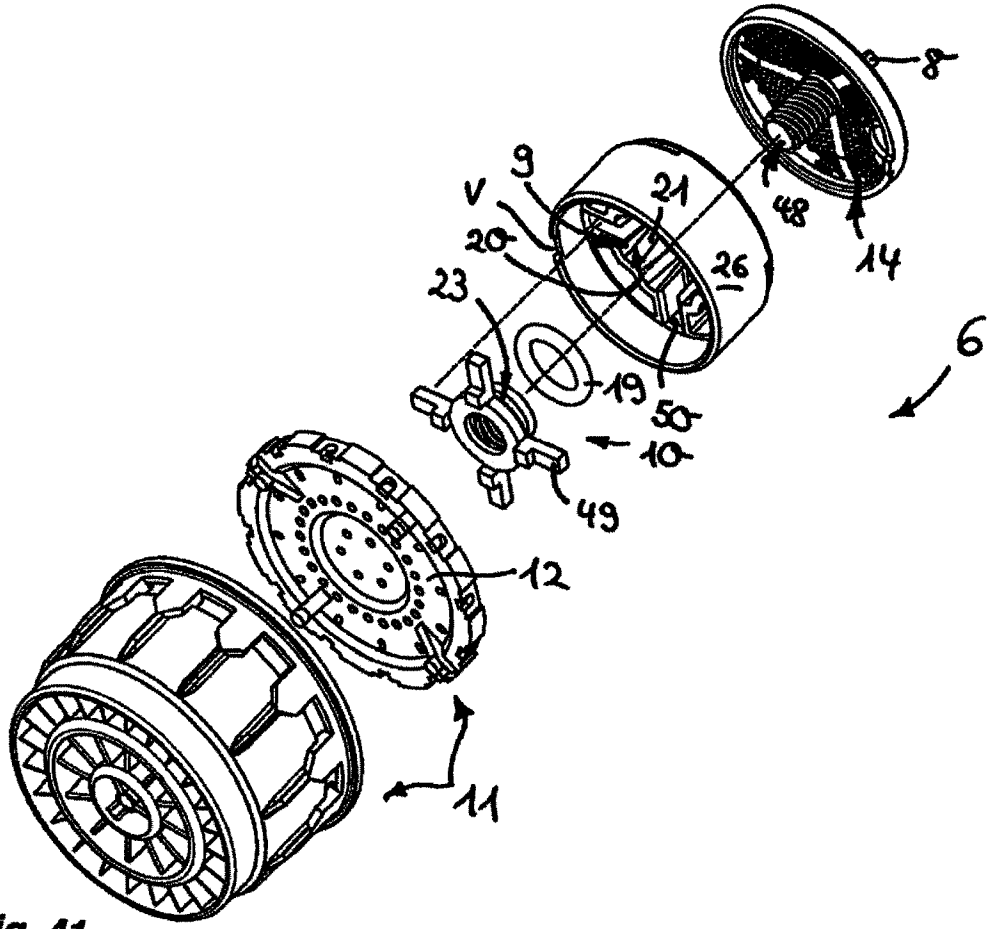
FIG. 41 shows the installation element from FIGS. 35 to 40 in an exploded perspective illustration, oriented counter to the inflow direction, of its individual parts.
Figure 42:
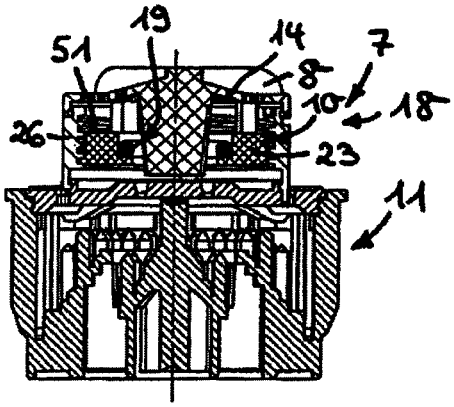
FIG. 42 shows a sanitary installation element illustrated in a longitudinally sectioned rotational position, which sanitary installation element has, on the inflow side, an adjustment device likewise designed as a throughflow rate regulator, wherein sliding projections provided on the outer circumference of an annular support for the throttle body engage on the housing inner circumference of the adjustment device.
Figure 44:
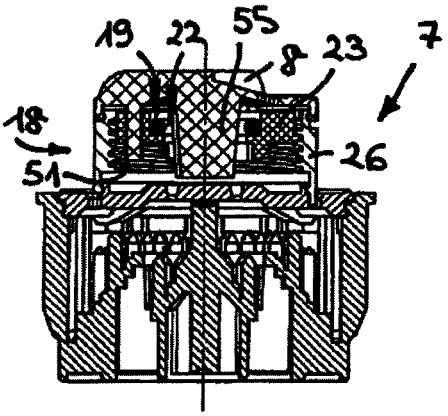
FIG. 44 shows the longitudinally sectioned installation element from FIGS. 42 and 43 in a different position of adjustment.
Figure 43:
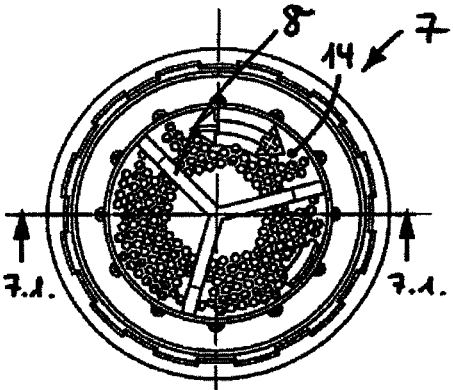
FIG. 43 shows the installation element shown in the rotational position as per FIG. 42 in a plan view of its inflow side.
Figure 45:
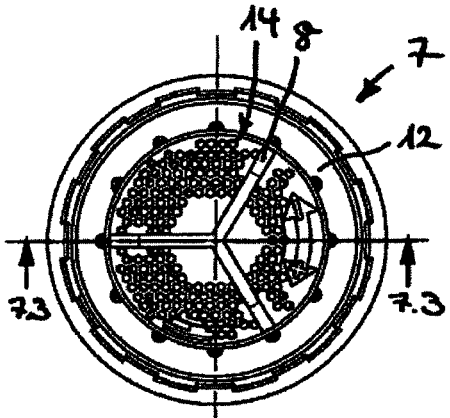
FIG. 45 shows the installation element shown in the rotational position as per FIG. 44 in a plan view of its inflow side.
Figure 47:
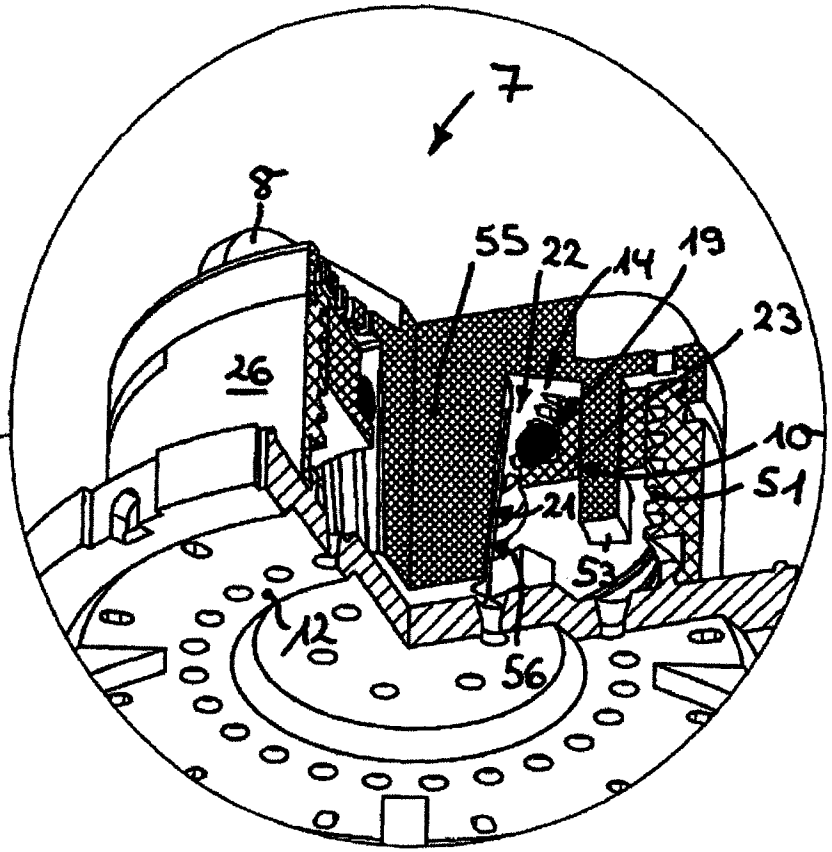
FIG. 47 shows the installation element from FIGS. 42 to 46 in an enlarged-scale longitudinal section detail from FIG. 46.
Figure 46:
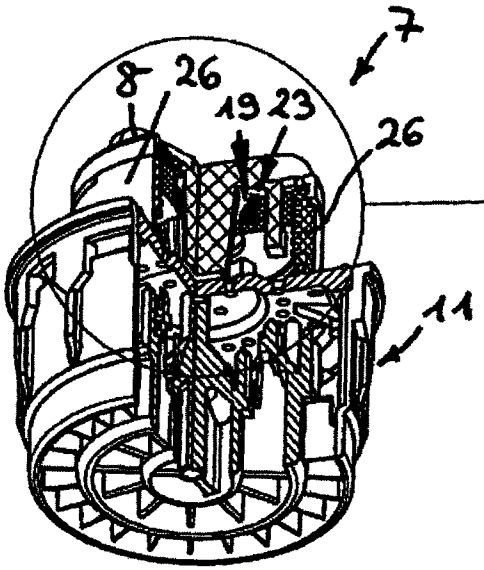
FIG. 46 shows the installation element from FIGS. 42 to 45 in a perspective partial longitudinal section.
Figure 48:
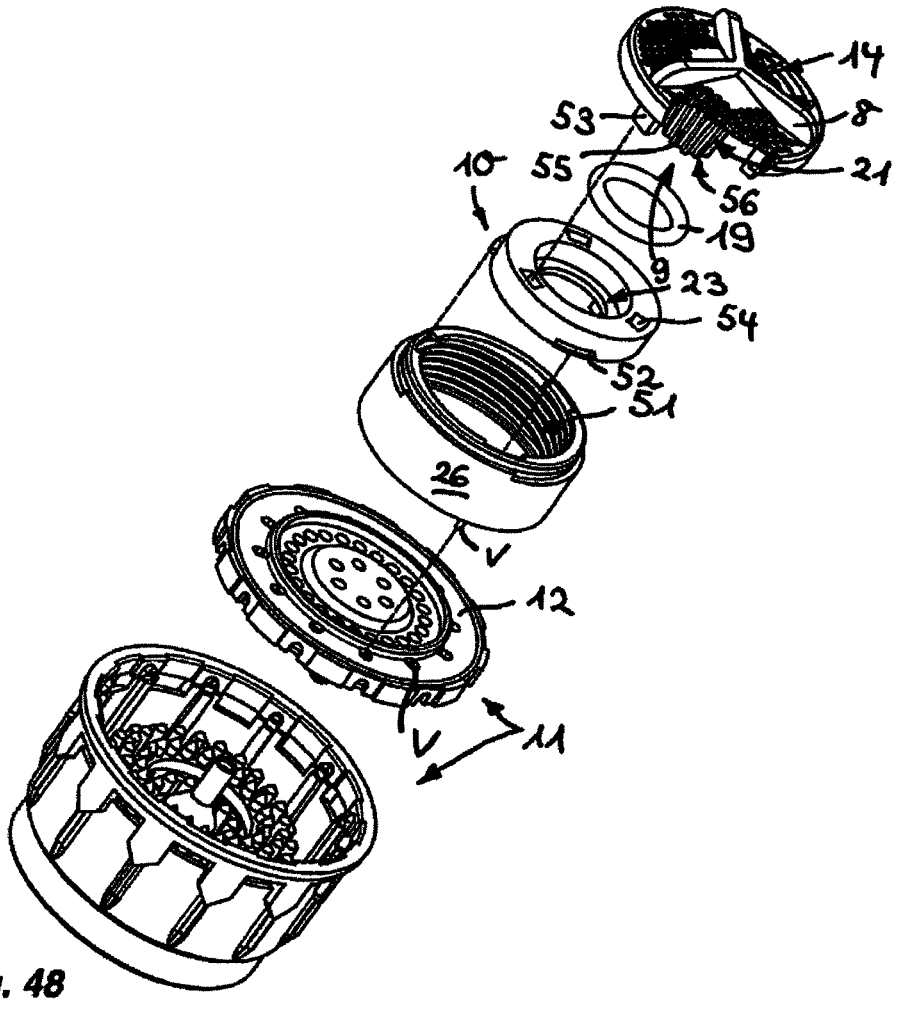
FIG. 48 shows the installation element from FIGS. 42 to 47 in an exploded perspective illustration of its individual parts.

FIGS. 1 to 48 illustrate different embodiments 1, 2, 3, 4, 5, 6 and 7 of a sanitary installation element. The installation elements 1, 2, 3, 4, 5, 6 and 7 can be inserted into, and are releasably held in, an outlet mouthpiece (not illustrated in any more detail here) on the water outlet of a sanitary outlet fitting. In order that the clear throughflow cross section or the throughflow rate (=throughflow of water per unit time in l/min) can be varied and adapted to the respective specifications of the distribution network which exists at the usage site, the installation elements 1, 2, 3, 4, 5, 6 and 7 have in each case an adjustment device which can be actuated via an operating element 8. Whereas the operating element 8 in the installation element 5 as per FIGS. 28 to 34 is provided on the outflow side of the installation element 5, the operating element 8 in the installation elements 1, 2, 3, 4, 5, 6 and 7 as per FIGS. 1 to 27 and 35 to 48 is arranged on the inflow side of said installation elements.

By actuation of the adjustment device on the operating element 8, the clear throughflow cross section and/or the water quantity emerging per unit time, defined below as volume flow, can be varied such that the installation elements 1, 2, 3, 4, 5, 6 and 7 can be made to satisfy the different preconditions of various distribution networks. Since one and the same installation element 1, 2, 3, 4, 5, 6 and 7 can be adapted to the specifications of the water networks found in different countries, the production and stockkeeping of different embodiments is no longer imperatively necessary.

The adjustment device of the installation elements 1, 2, 3, 4, 5, 6 and 7 has a regulating element 9 and, interacting therewith, an adjustment element 10, the relative position of which can be varied by means of the at least one operating element 8 in order to vary the throughflow cross section or the volume flow. The rotatably mounted operating element 8 is drive-connected to the adjustment device in such a way that a rotational movement at the operating element 8 can be converted into a longitudinal movement of the adjustment element 10 which is guided so as to be movable in the longitudinal direction of the adjustment device.

Here, the installation elements 1, 2, 3, 4, 5, 6 and 7 have a jet regulator 11, the intention of which is to form a homogeneous, non-sputtering and if appropriate sparkling, soft water jet. The jet regulator 11 of the installation elements 1, 2, 3, 4, 5, 6 and 7 has a jet splitter 12, the task of which is to temporarily split up the water flowing through into a multiplicity of individual jets. For this purpose, the jet splitter 12 is in the form of a perforated plate which has a multiplicity of throughflow holes. The throughflow holes provided on the jet splitter are arranged in at least one hole circle 13, and if appropriate in a plurality of coaxial hole circles 13 (cf. FIG. 6).

The installation elements 1, 2, 3, 4, 5, 6 and 7 have an inflow-side upstream or filter screen 14, the task of which is to filter out any dirt particles entrained in the inflowing water. In the installation elements 1, 2, 3, 4, 6 and 7, the upstream or filter screen 14 which is accommodated in the interior of the water outlet so as to be secured against unauthorized or inadvertent manipulation is in the form of an operating element 8 which is held in the longitudinal direction but which is nevertheless mounted so as to be rotatable.

The installation element 1 as per FIGS. 1 to 6 has the jet regulator 11, which in this case has the jet splitter 12 which is in the form of a perforated plate 12 and which simultaneously serves as a regulating element 9. The jet splitter 12 has two coaxial hole circles 13 with throughflow holes. On the perforated plate which serves as a jet splitter 12 there is provided a sleeve-shaped or annular housing 26 of the scissor device. A wheel-shaped adjustment element 10 is guided so as to be displaceable in the longitudinal direction, but rotationally fixed, in the housing 26. The adjustment element 10 can be moved between an open position and a closed position shown in FIG. 3. In the closed position as per FIG. 3, the wheel-shaped adjustment element 10 rests with a partial region 16*a* of its central "wheel hub" on the inner hole circle 13 of the jet splitter 12 designed as a regulating element, in such a way that said inner hole circle 13 is sealingly closed off and only the outer hole circle 13 remains open. The throughflow cross section of the installation element 1 is therefore reduced in the closed position as per FIG. 3. In the center of the adjustment element 10 there is provided a threaded opening 16 into which a threaded peg 17 engages. The threaded peg 17 protrudes from the outflow side of the operating element 8 designed as an upstream or filter screen 14, in such a way that a rotational movement at the operating element 8 can be converted into a longitudinal movement of the adjustment element 10.

In the installation elements 2 to 7, the adjustment device is in the form of an adjustable throughflow rate regulator 18, the task of which is to regulate the water quantity flowing through per unit time to a preselectable constant value. The throughflow rate regulator 18 which serves as an adjustment device has an annular throttle body 19 which is composed of elastic material and which delimits a control gap 22 between itself and a regulating profiling 21 provided on an adjacent circumferential wall 20, which control gap 22 can be varied in terms of its clear throughflow cross section by means of the throttle body 19 which deforms under the pressure of the fluid flowing through. In order to be able to vary the throughflow rate in the throughflow rate regulator 18 which serves as an adjustment device, it is provided that the circumferential wall 20, at least in its partial region which has the regulating profiling 21, and/or the regulating profiling 21 itself, narrow or widen in terms of their clear cross section in the longitudinal direction.

In the installation elements 4 to 7, a support 23 intended for providing support for the throttle body 19 is formed as an adjustment element 10 which is adjustable in the longitudinal direction, whereas the circumferential wall 20 which has the regulating profiling 21 is provided as a regulating element 9.

By contrast, in the installation elements 2 and 3, the circumferential wall 20 is provided as an adjustment element 10, which adjustment element 10 is guided so as to be displaceable in the longitudinal direction relative to the support 23 which bears the throttle body 19 and which is designed as a regulating element 9.

In the installation elements 2, 3, 4, 6 and 7, the adjustment device designed as a throughflow rate regulator 18 is releasably held on the inflow side of the jet regulator 11 or similar installation part.

The installation element 2 as per FIGS. 7 to 12 has an upstream or filter screen 14 which serves as an operating element 8 and on the outflow side of which there is integrally formed a mushroom-shaped or T-shaped support peg or similar support 23 which protrudes in the axial direction. The annular throttle body 19 is seated on the cross section of the T shape of said support 23. The support 23 which serves as a regulating element 9 is engaged around by a profile ring 25, the inner circumferential wall 20 of which is provided as an adjustment element 10 and bears the regulating profiling 21. On the housing inner circumference of the housing 26 of the adjustment device there is provided an internal thread 27 into which engage sliding pegs 28 or similar projections which protrude from the outer circumference of the profile ring 25. The profile ring 25 is connected, so as to be adjustable in the longitudinal direction but nevertheless rotationally conjoint, to the operating element 8 designed as an upstream or filter screen 14, in such a way that a rotational movement at the operating element 8 can be converted by means of the internal thread 27 provided on the housing 26 into a longitudinal movement of the profile ring 25 and thus into a relative movement between the regulating profiling 21, provided on the inner circumferential wall 20 of the profile ring 25, and the throttle body 19. The housing 26 of the adjustment device can be releasably latched to the jet splitter 12, which is designed as a perforated plate, of the jet regulator 11. The jet splitter 12 is one of the constituent parts of the jet regulator 11 positioned downstream in the throughflow direction. The jet regulator 11 has, in its jet regulator housing 29, further structures by means of which the water flowing through is formed in the desired manner.

In the installation element 3, the housing 26 of the adjustment device designed as a throughflow rate regulator 18 is likewise releasably fastened to the jet splitter 12 of the jet regulator 11 positioned downstream in the flow direction. The housing 26 of the adjustment device has, on the housing inner circumference, a plurality of ramps 30 which are spaced apart uniformly over the housing circumference and which in this case are of stepped form, on which ramps is seated a profile ring 31. The profile ring 31 has the regulating profiling 21 on its inner circumferential wall 20 which serves as an adjustment element 10. The operating element 8 which is designed as an upstream or filter screen 14 and which is rotatably held on the housing 26 of the adjustment device is drive-connected to the profile ring 31 in such a way that, as a result of a rotational movement at the operating element 8, the profile ring 31 connected thereto can also be advanced in a stepped manner on the ramps 30 and displaced in the longitudinal direction in such a way that the relative movement between the inner circumferential wall 20 provided as an adjustment element 10, on the one hand, and the support 23 which bears the throttle body 19 is varied. Said support 23 is formed centrally into the housing 26 of the adjustment device and is engaged around by the profile ring 31. Similarly to the situation in the installation element 2, drive pegs 32 protrude from the outflow side of the operating element 8, which drive pegs engage into corresponding coupling recesses 33 on the profile ring 31 in such a way that the profile ring 31 is drive-connected to the operating element 8 in a rotationally conjoint but relatively displaceable manner.

In the installation element 4, the housing 26 of the adjustment device is of pot-shaped form. The housing edge 34, which projects laterally in the manner of a flange, of the housing 26 is rotatably held on and preferably releasably latchable to the inflow side of the jet regulator 11 positioned downstream in the flow direction. The pot base of the pot-shaped housing 26 is designed as the upstream or filter screen 14, which simultaneously also serves as an operating element 8. A thread or helical groove 35 is provided on the housing inner circumference of the housing 26. In the housing interior of the housing 26 there is provided a disk-shaped support 23 for the throttle body 19, which support has on its outer disk edge a plurality of sliding pegs 28 or similar sliding pieces which are arranged so as to be distributed over the disk circumference and which protrude into the helical groove 35 in such a way that a rotational movement at the operating element 8 can be converted into a sliding movement of the support 23 which serves as an adjustment element 10. The support 23 is guided in the housing 26 in a displaceable but rotationally fixed manner. For this purpose, the support 23 is formed in the manner of a spoked wheel, wherein the spokes 37 of said wheel shape engage into longitudinal grooves 38 which bear a profile ring 39. Said profile ring 39, which can be releasably latched to the jet splitter 12 of the downstream jet regulator 11, has the circumferential wall which serves as a regulating element 9 and which bears the regulating profiling 21.

In the installation element 5, the adjustment device positioned upstream of the jet regulator 11 is designed as a throughflow rate regulator 18. The throttle body 19 which is produced from elastic material rests on a support 23 which is guided in the installation element 5 so as to be displaceable in the longitudinal direction. A threaded peg 40 with internal thread is integrally formed on the support 23 which protrudes into the upstream or filter screen 14 and which serves as an adjustment element 10. The threaded peg 40 which is connected to the support 23 is guided in a guide sleeve 41 so as to be displaceable in the longitudinal direction of the adjustment device, which guide sleeve 41 is provided centrally on the jet splitter 12 of the jet regulator 11. The threaded portion 42 an operating element 8 is screwed into the internal thread of the threaded peg 40. The operating element 8, which in this case is in the form of a screw, is clamped with the head 43 of its screw shape between the free end region of the guide sleeve 41 and a flow straightener 44, which forms the outflow side of the installation element 5 and which in this case is formed with honeycomb-cell-shaped throughflow holes, in such a way that the operating element 8, which with one partial region extends through a handling opening 45 and protrudes beyond the flow straightener 44, is mounted in the installation element 5 so as to be rotatable but immovable in the longitudinal direction. A rotational movement at the operating element 8 is transmitted via the external thread on the threaded portion 42 and the internal thread of the threaded peg 40 to the support 23, which serves as an adjustment element 10, in such a way that the throttle body 19 resting on said support can be moved in the axial direction relative to the on a inner circumferential wall 20 which serves as a regulating element. The support 23 of the adjustment device assigned to the installation element 5 is also formed in the manner of a spoked wheel, wherein the wheel spokes 46 of said spoked wheel shape are guided in guide grooves 47 of the inner circumferential wall 20 which bears the regulating profiling 21, in such a way that the adjustment element 10 can be displaced in the longitudinal direction, but not rotated, by a rotational movement at the operating element 8.

The installation element 6 likewise has an adjustment device designed as a throughflow rate regulator 18. On the inflow-side face edge region of the housing 26 of the adjustment device there is rotatably mounted an upstream or filter screen 14 which simultaneously also serves as an operating element 8 of the adjustment device. A threaded peg 48 is integrally formed on the operating element 8. An annular support 23 with an internal thread is screwed onto the external thread of the threaded peg 48. The support 23 which is intended for providing support for the throttle body 19 and which serves as an adjustment element 10 has guide pegs 49 which protrude from the outer circumference of its ring shape and which engage into guide grooves 50 of the housing 26 of the adjustment device in such a way that the support 23 is guided so as to be rotationally fixed, but displaceable in the longitudinal direction, in the housing 26. The housing 26 is releasably held on the jet splitter 12, which is designed as a perforated plate, of the jet regulator 11 provided at the outflow side. The rotational movement which is imparted to the threaded peg 48 by means of the operating element 8 is converted into a longitudinal movement of the support 23 which serves as an adjustment element 10. The regulating profiling 21 is provided on an inner circumferential wall 20, which is designed as a regulating element 9, of the housing 26. It is thus possible by means of the operating element 8 for the relative position between the adjustment element 10 and the regulating element 9 to be varied such that the throughflow rate of the installation element 6 can be varied as required.

The adjustment device, which is designed as a throughflow rate regulator 18, of the installation element 7 as per FIGS. 42 to 48 has a housing 26 which bears an internal thread 51 on its housing inner circumference. In the housing interior of the housing 26 there is displaceably guided an annular support 23 for the throttle body 19, which support serves as an adjustment element 10 and has on its outer circumference sliding pegs 52 which protrude into the internal thread 51. Drive pegs 53 protrude from the operating element 8 which is rotatably mounted on the inflow-side face edge region of the housing 26 and which is in this case designed as an upstream or filter screen 14, which drive pegs are oriented in the longitudinal direction of the adjustment device and engage in a displaceable but rotationally fixed manner into coupling openings 54 on the inflow-side face edge of the annular support 23. A rotational movement at the operating element 8 is thus transmitted to the support 23 in such a way that the support 23 can be displaced along the internal thread 51 of the housing 26 in the longitudinal direction of the adjustment device. By means of the longitudinal movement of the support 23 and of the throttle body 19 situated thereon, it is possible to realize a variation of the relative position between the throttle body 19 and a regulating profiling 21 which is provided on the outer circumference 56 of a regulating core 55 which is integrally formed on the operating element 8 and which tapers conically in the axial direction toward the free end and which serves as a regulating element 9.

From a comparison of FIGS. 2, 4 and 14, 17, it is clear that a rotational position indicator 79 may be provided to allow identification of the selected rotational position of the adjustment element 10. In the installation elements 1, 3 illustrated in FIGS. 2, 4 and 14, 17, said rotational position indicator has a display opening 81 in the upstream screen 14, which display opening interacts with characteristic numbers, characteristic figures or similar characteristic symbols provided on the adjacent end surface of the jet regulator housing.

In order to secure the relative position between the jet splitter 12 and the inflow-side components 26, 29, said mutually adjacent components of the installation elements 1, 2, 3, 4, 6 and 7 engage into one another by way of twist prevention means V. End stops A may be provided in order to limit the adjustment movement of the operating element 8.

The invention claimed is:

1. A sanitary installation element (1, 2, 3, 4, 5, 6, 7) which can be inserted into a water outlet of a sanitary outlet fitting, comprising an adjustment device for varying at least one of a clear throughflow cross section of the installation element or a volume flow, said adjustment device is actuatable by at least one operating element (8) arranged such for actuation on at least one of an inflow side of the installation element or on an outflow side of said installation element, wherein the adjustment device has a regulating element (9) and, interacting therewith, an adjustment element (10), a relative position of which can be varied by the at least one operating element (8) in order to vary the throughflow cross section or a throughflow rate, the at least one operating element (8) is mounted so as to be rotatable but immovable in a longitudinal direction, the adjustment element is guided so as to be displaceable in the longitudinal direction and rotationally fixed, and a rotational movement at said operating element (8) is convertible into a longitudinal movement of the adjustment element, wherein the adjustment device is in the form of a throughflow rate regulator (18) which has an annular throttle body (19) comprised of elastic material that delimits a control gap (22) between itself and a regulating profiling (21) provided on at least one of an adjacent inner or outer circumferential wall (20, 56), said control gap (22) is variable in terms of its clear throughflow cross section by the throttle body (19) which deforms under pressure of fluid flowing through.

2. The installation element (2, 3, 4, 5, 6, 7) as claimed in claim 1, wherein at least one of the inner or the outer circumferential wall (20, 56), at least in partial region which has the regulating profiling (21), or the regulating profiling (21), widen in terms of a clear cross section in the longitudinal direction.

3. The installation element (2, 3, 4, 5, 6, 7) as claimed in claim 2, wherein a support (23) for the throttle body (19), or at least one of the inner or outer circumferential wall (20, 56) which has the regulating profiling (21), is designed as the adjustment element (10) which interacts with at least one of the inner or outer circumferential wall (20, 56) which is designed as the regulating element (9) or with the support (23).

4. The installation element (2, 3, 4, 5, 6, 7) as claimed in claim 3, wherein the adjustment device can be releasably fastened on the inflow side of a jet regulator (11) or similar sanitary installation part.

5. The installation element (2, 3) as claimed in claim 3, wherein the adjustment device has a sleeve-shaped housing (26), in a housing interior of which the support (23) which serves as a regulating element (9) is arranged so as to be immovable in the longitudinal direction.

6. The installation element (2, 3) as claimed in claim 3, wherein the adjustment element (10) is formed as the inner circumferential wall (20), which bears a regulating profiling (21), of a profile ring.

7. The installation element (2, 3) as claimed in claim 6, wherein the support (23) which bears the throttle body (19) protrudes into the ring opening of the profile ring.

8. The installation element (2, 4, 7) as claimed in claim 7, wherein the housing (26) of the adjustment device bears an internal thread on a housing inner circumference thereof, and on the outer circumferential wall of the adjustment element (10), at least one external thread, a sliding peg or projection protrudes into the internal thread.

9. The installation element (2) as claimed in claim 8, wherein the support (23) is held on the operating element (8).

10. The installation element (3) as claimed in claim 9, wherein the sleeve-shaped housing of the adjustment device which bears at least one ramp (30) on a housing inner circumference, the adjustment element (10) is formed as the inner circumferential wall, which bears a regulating profiling (21), of an annular adjustment element (10) which rests on the at least one ramp (30), and a rotational movement at the at least one operating element (8) can be converted by the at least one ramp (30) into a longitudinal movement of the adjustment element resting on the at least one ramp (30).

11. The installation element (2, 3, 7) as claimed in claim 10, wherein at least one driver or drive peg protrudes from the operating element (8), said driver or drive peg engages into an associated driver or coupling opening on the adjustment element.

12. The installation element (4) as claimed in claim 11, wherein the filter or upstream screen (14) formed as the operating element (8) is of pot-shaped form, the filter or upstream screen (14) is mounted with a pot edge region thereof in a rotatable manner on the inflow side of the installation part (11), the filter or upstream screen (14) has, on a pot inner circumference of the pot shape, a thread or a helical groove (35) into which protrudes a counterpart threat or at least one sliding piece or similar projection on an outer circumference of the support (23) formed as the adjustment element (10), which support a profile ring is provided which is held in a rotationally fixed manner on the installation element (4) and the inner circumferential wall (20) of which, formed as the regulating element, bears the regulating profiling (21), and the support (23) is wheel-shaped and is guided with spokes of the wheel shape in guide grooves or openings of the profile ring in a rotationally fixed manner but so as to be displaceable in the longitudinal direction.

13. The installation element (5) as claimed in claim 3, wherein a threaded peg or a threaded sleeve protrudes from the support (23) designed as the adjustment element (10), said threaded peg or sleeve is guided in a rotationally fixed but displaceable manner in the installation element (5) and interacts with a counterpart thread of a threaded sleeve or of a threaded peg whose outflow-side sleeve or peg end region, which protrudes beyond the installation element (5), is designed as the operating element, and the regulating profiling is provided on the inner circumferential wall (20), designed as the regulating element (9), of the installation element (5).

14. The installation element (6) as claimed in claim 3, wherein the support (23) is designed as the adjustment element (10) and is guided on the housing inner circumference of the housing (26) of the adjustment device so as to be displaceable in the longitudinal direction of the adjustment device.

15. A sanitary installation element (1, 2, 3, 4, 5, 6, 7) which can be inserted into a water outlet of a sanitary outlet fitting, comprising a housing having a throughflow cross-section, a perforated plate extending across the throughflow cross-section of the housing, the perforated plate including a plurality of throughflow holes defined therein through which a flow of water is directed, an adjustment device for varying at least one of the clear throughflow cross-section of the installation element or a volume flow, said adjustment device is actuatable by at least one operating element (8) arranged for actuation on at least one of an inflow side of the installation element or on an outflow side of said installation element, wherein the adjustment device has a regulating element (9) and, interacting therewith, an adjustment element (10), a relative position of which can be varied by the at least one operating element (8) in order to vary the throughflow cross section or a throughflow rate, the at least one operating element (8) is mounted so as to be rotatable but immovable in a longitudinal direction, the adjustment element is guided so as to be displaceable in the longitudinal direction and rotationally fixed, and a rotational movement at said operating element (8) is convertible into a longitudinal movement of the adjustment element.

* * * * *